US005463999A

United States Patent [19]

Taruya et al.

[11] Patent Number: 5,463,999

[45] Date of Patent: Nov. 7, 1995

[54] IGNITION COIL UNIT FOR AN INTERNAL COMBUSTION ENGINE AND MANUFACTURING METHOD OF THE SAME

[75] Inventors: Masaaki Taruya; Mitsuru Koiwa, both of Himeji, Japan

[73] Assignee: Mitsubishi Denki Kabushiki Kaisha, Tokyo, Japan

[21] Appl. No.: 107,571

[22] Filed: Aug. 18, 1993

[30] Foreign Application Priority Data

Aug. 21, 1992 [JP] Japan ..... 4-222809

[51] Int. Cl.[6] ..... F02P 3/00

[52] U.S. Cl. ..... 123/647; 29/602.1; 336/96; 336/192; 361/728

[58] Field of Search ..... 123/634, 635, 123/647; 336/96, 192; 29/602.1; 361/253, 728

[56] References Cited

U.S. PATENT DOCUMENTS 4,268,810 5/1981 Iwasa et al. ..... 336/205

5,172,302 12/1992 Taruya et al. ..... 361/386

5,296,999 3/1994 Taruya ..... 123/647

*Primary Examiner*—Noah P. Kamen

*Attorney, Agent, or Firm*—Sughrue, Mion, Zinn, Macpeak & Seas

[57] ABSTRACT

An ignition coil unit comprises a coil assembly (55) having an ignition coil (A), a power switch circuit (B) having a plurality of electric and electronic components therein for interrupting an electric current flowing through the ignition coil (A) and a terminal conductor (8) for electrically connecting the coil assembly (55) to an external circuit, and an electrically insulating transfer-molded resin (50) disposed around the coil assembly (55) for supporting therein the coil assembly (55). Further, the ignition coil (A), the power switch circuit (B) and the terminal conductor (8) are mechanically connected into the coil assembly (55). The present invention also resides in a method for manufacturing the same.

10 Claims, 4 Drawing Sheets

IGNITION COIL UNIT FOR AN INTERNAL COMBUSTION ENGINE AND MANUFACTURING METHOD OF THE SAME

BACKGROUND OF THE INVENTION

This invention relates to an ignition coil unit for an internal combustion engine and, more particularly, to an ignition coil unit in which an ignition coil and a power switch for controlling a primary current through the ignition coil are integrally combined into a unit.

FIG. 4 is an electrical circuit diagram of a known ignition coil unit for an internal combustion engine. The ignition coil unit comprises an ignition coil A having a primary winding 2 and a secondary winding 6, and a power switch circuit B having a plurality of electric and electronic circuit components. In FIG. 4, it is also seen that an electric source C and an ignition signal control circuit D are connected to the ignition coil unit.

The power switch circuit B comprises a power transistor 1 for switching a primary current flowing through the primary winding 2 of the ignition coil A, a current limiting circuit 4 and a current detecting circuit 3 for detecting a potential difference generated by the primary current and for transmitting a primary current control signal to the current limiting circuit 4.

FIG. 5 is a front view of the known ignition coil unit before it is filled with insulating resin, and FIG. 6 is a sectional side view of the ignition coil unit illustrated in FIG. 5 in which the ignition coil A and the power switch circuit B are integrally combined. In FIGS. 5 and 6, the secondary winding 6 of the ignition coil A is disposed within a casing 5 and concentrically wound around the primary winding 2 of the ignition coil A and an iron core 7. Thus, the ignition coil A is composed of the primary winding 2, the secondary winding 6 and the iron core 7. The iron core 7 is substantially C-shaped member having a pair of substantially U-shaped members welded together at an end of one of the legs of the U positioned in an opposing relationship. An air gap 7*a* is defined between opposing legs of the U-shaped members. One leg 7*b* of each of the U-shaped members is much longer than the other leg 7*c* and the air gap 7*a* is not centrally located with respect to the ignition coil A. A heat dissipating plate 22 made for example of aluminum is disposed in the casing 5 and a packaged power switch circuit 23 having the power switch circuit B therein is attached to the heat dissipating plate 22. The packaged power switch circuit 23 comprises a mold resin, 23*a* hermetically sealing and packaging the power switch circuit B into a single unitary piece by the transfer molding. A connector 8 is integrally molded with the casing 5. As illustrated in FIG. 6, an electrically insulating resin 9 is filled within the casing 5.

As seen from FIGS. 5 and 6, the connector 8 has a plurality of connector terminals 11, 13, 15, 18. The first connector terminal 11 is electrically connected to the one end of the secondary winding 6 through a secondary winding ground line 10 and the second connector terminal 13 is electrically connected to the one end of the primary winding 2 through a source line 12. The third connector terminal 15 is electrically connected to a base terminal 16 of the power transistor 1 (See FIG. 4) in the power switch circuit B within the packaged power switch circuit 23 through a control signal line 14. The fourth connector terminal 18 is electrically connected to a ground terminal 19 of the power switch circuit B through a ground line 17. A collector terminal 21 of the power transistor 1 is electrically connected to the other end of the primary winding 2 through a collector line 20.

In the known ignition coil unit as described above, the primary current of the primary winding 2 flows through the current detection circuit 3, where the current level is detected as the potential difference upon which a control signal is supplied to the current limiting circuit 4. The current limiting circuit 4 controls the primary current flowing through the primary winding 2 of the ignition coil A in accordance with this control signal. In response to this primary current flowing through the primary winding 2, a high voltage to be supplied to a distributor (not shown) is generated in the secondary winding 6 of the ignition coil A.

With the known ignition coil unit as described above, after the packaged power switch 23 and the primary and secondary windings 2, 6 are mounted within the casing 5, electrical connections such as the connections between the connector terminals 11, 15, 18, 13 of the connector 8, the primary and secondary windings 2, 6 of the ignition coil A and the power switch circuit B must be provided through separate electrical conductors 10, 12, 14, 17, 20 within the limited space in the casing 5. Therefore, the ignition coil unit cannot be easily and speedily assembled, and these connecting portions sometimes fail to be tightly and correctly connected, and thus may be easily damaged.

SUMMARY OF THE INVENTION

Accordingly, one object of the present invention is to provide an ignition coil unit for an internal combustion engine free from the above-discussed problems of the known ignition coil unit.

Another object of the present invention is to provide an ignition coil unit which can be easily assembled and reliable.

A further object of the present invention is to provide an ignition coil unit which simplifies the connecting processes between the ignition coil and the power switch circuit.

With the above objects in view, the ignition coil unit of the present invention comprises a coil assembly having an ignition coil, a power switch circuit having a plurality of electric and electronic components therein for interrupting an electric current flowing through the ignition coil and a terminal conductor for electrically connecting the coil assembly to an external circuit, and an electrically insulating transfer-molded resin disposed around the coil assembly for supporting therein the coil assembly. Further, the ignition coil, the power switch circuit and the terminal conductor are mechanically connected into the coil assembly.

The present invention also resides in a method for manufacturing an ignition coil unit, comprising the steps of preparing an ignition coil and a power switch circuit having a plurality of electric and electronic components therein for interrupting an electric current flowing through the ignition coil, electrically connecting the power switch circuit and the ignition coil into a coil assembly and transfer-molding an electrically insulating resin around the coil assembly for hermetically sealing and supporting therein the coil assembly. The method further comprises the step of mechanically connecting the ignition coil and the power switch circuit together.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 2:
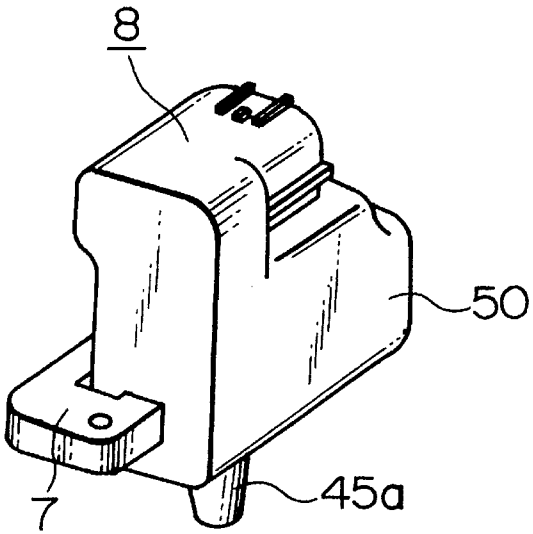
FIG. 2 is a perspective view of the ignition coil unit illustrated in FIG. 1.
Figure 1:
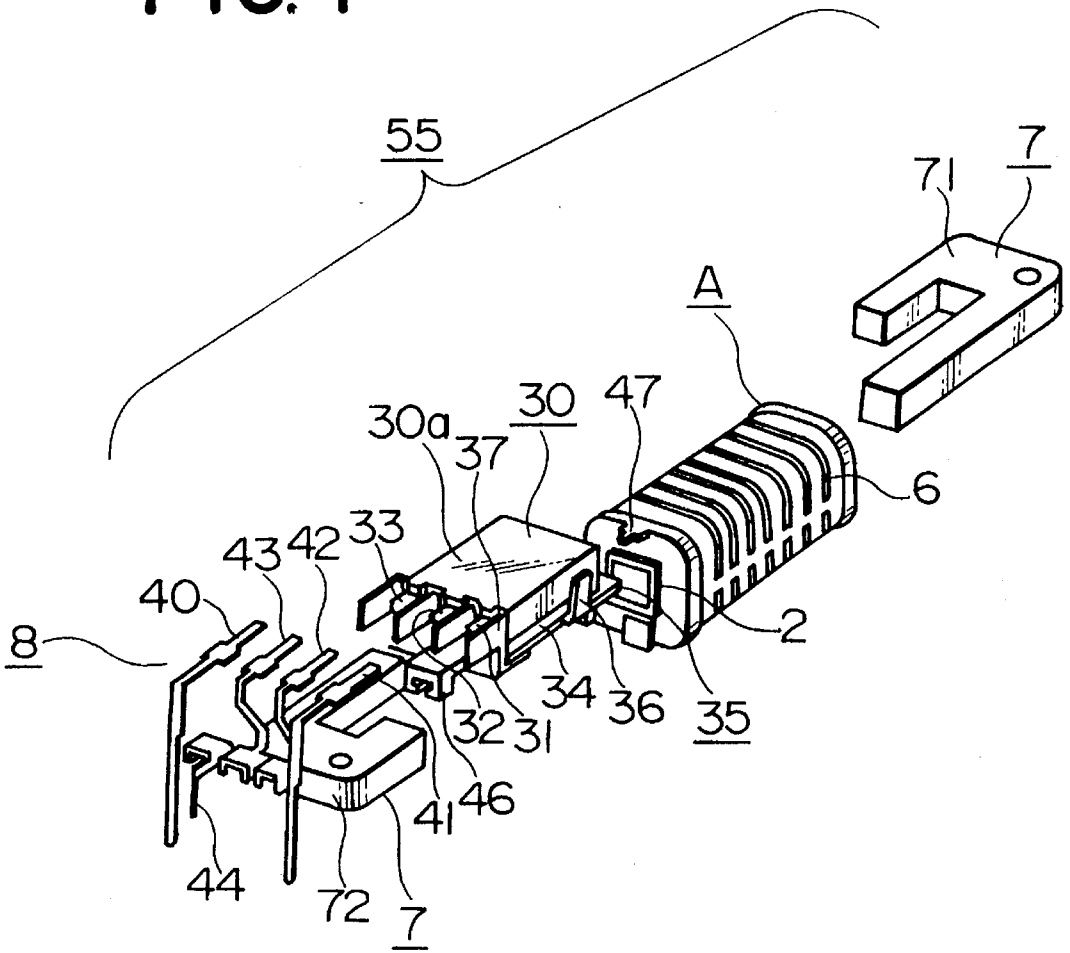
FIG. 1 is an exploded perspective view illustrating one embodiment of an ignition coil unit of the present invention.

FIGS. 1 and 2 illustrate an embodiment of an ignition coil unit of the present invention which comprises an electrically insulating transfer-molded resin 50 and a coil assembly 55 disposed within the transfer-molded resin 50.

Figure 3:
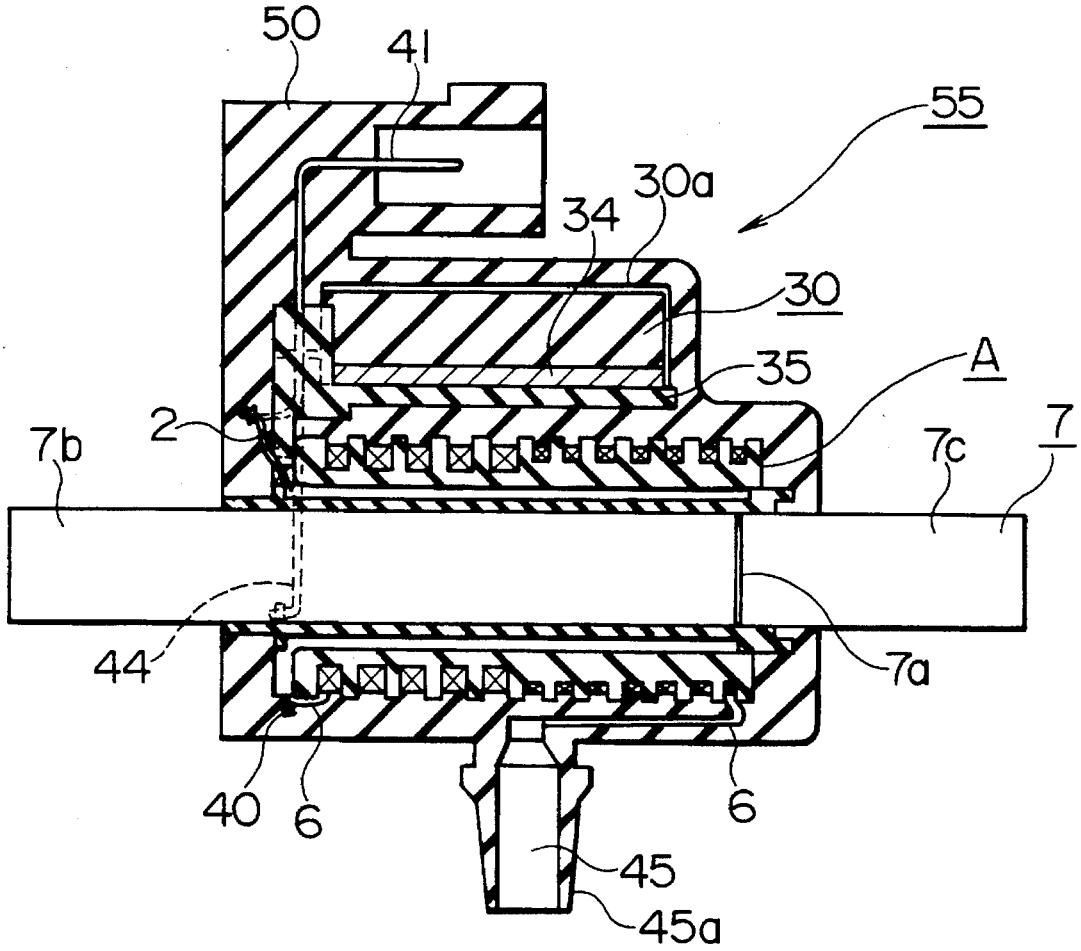
FIG. 3 is a sectional view of the ignition coil unit illustrated in FIGS. 1 and 2.
Figure 4:
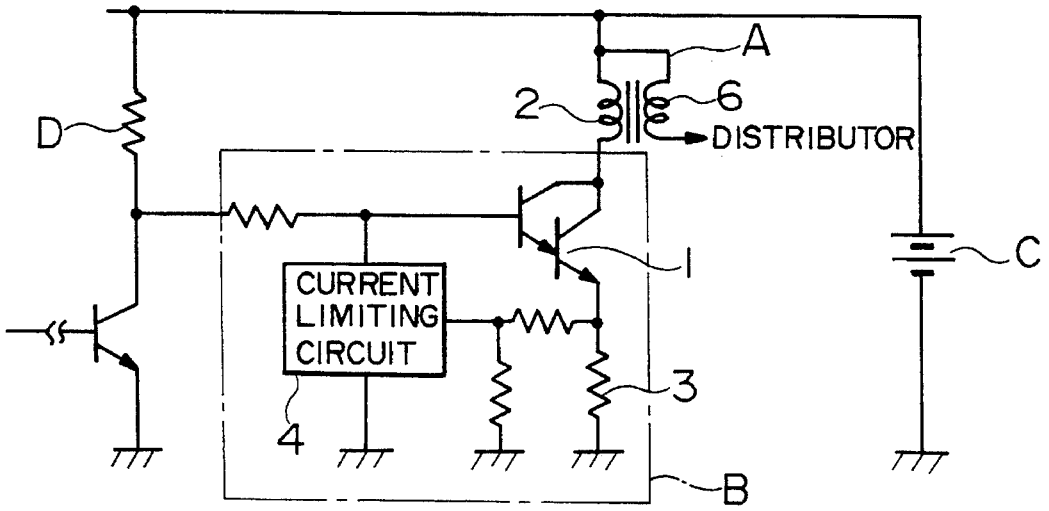
FIG. 4 PRIOR ART
FIG. 4 is a circuit diagram of a known ignition coil to which the present invention is applicable.

The coil assembly 55 is composed of an ignition coil A and a power switch circuit 30 which are mechanically and electrically connected to each other as illustrated in FIG. 3 showing a sectional view of the ignition coil unit. The power switch circuit 30 comprises a plurality of electric and electronic components (not shown) which compose the power switch circuit B illustrated in FIG. 4 including the power transistor 1 and the current limiting circuit 4 and the like. The power switch circuit 30 also comprises a mold resin for hermetically sealing therein these electric and electronic components. In this embodiment, the power switch circuit 30 which is previously molded with the mold resin, that is, the packaged power switch circuit 30 as illustrated in FIGS. 1 and 3 is used. However, the non-packaged power switch circuit which is not molded may be used. The ignition coil A has a primary winding 2 and a secondary winding 6 concentrically wound around the primary winding 2.

Inserted into the primary winding 2 is an iron core 7 and the substantially C-shaped iron core 7 has a pair of substantially U-shaped members 71, 72 which are welded together at an end of one of the legs of the U positioned in an opposing relationship. As illustrated in FIG. 3, one leg 7*b* of the iron core 7 is much longer than the other leg 7*c* and an air gap 7*a* between the legs 7*b* and 7*c* is not centrally located with respect to the ignition coil A, but is positioned close to one of axial ends of the ignition coil A. Then, as the packaged power switch circuit 30 is relatively remote from the air gap 7*a*, a heat generated at the air gap 7*a* does not affect the packaged power switch circuit 30.

As illustrated in FIG. 1, the packaged power switch circuit 30 is mounted on a holder 35 and supported by means of a pair of supporting plates 36 extending upwardly from the bottom of the holder 35 along the opposite side surfaces of the packaged power switch circuit 30. Disposed between the packaged power switch circuit 30 and the holder 35 is a heat dissipating plate 34 made for example of aluminum and attached to the packaged power switch circuit 30. The packaged power switch circuit 30 may be, if necessary, covered with cover means 30*a* such as a silicone sheet for protecting from and absorbing stress caused therebetween. The packaged power switch circuit 30 has a base terminal 31, a ground terminal 32 and a collector terminal 33 which extend outwardly from the mold resin of the packaged power switch circuit 30 and are partitioned by partition walls 37 provided to the holder 35. The partition walls 37 extend from the holder 35 parallel to the terminals 31, 32, 33.

A connector 8 is integrally molded with the casing 50 as illustrated in FIG. 2. The connector 8 has a plurality of connector terminals 40, 41, 42, 43, 44. The first connector terminal 40 is electrically connected to the one end of the secondary winding 6 and the second connector terminal 41 is electrically connected to the one end of the primary winding 2 and the third connector terminal 42 is electrically connected to the base terminal 31 of the packaged power switch circuit 30. The fourth connector terminal 43 is electrically connected to the ground terminal 32 of the packaged power switch circuit 30. The terminal 44 electrically connects the collector terminal 33 of the packaged power switch circuit 30 to the other end of the primary winding 2. As illustrated in FIG. 3, a secondary terminal 45 is electrically connected to the other end of the secondary winding 6 for supplying a high voltage generated in the secondary winding 6 to the distributor (not shown). The secondary terminal 45 comprises an outer case 45*a* illustrated in FIG. 2 which can be integrally manufactured by the transfer-molding at the time when the transfer-molded resin 50 is manufactured. Thus, the packaged power switch circuit 30 and the ignition coil A are electrically connected to each other through these terminals.

As illustrated FIG. 1, the holder 35 has a recessed coupler 46 for receiving a projection 47 provided on the ignition coil A. The projection 47 has a substantially T-shaped cross-section and snugly fit into the recessed coupler 46 so that a relatively firm mechanical connection is established between the holder 35 and the ignition coil A. Therefore, the ignition coil A and the packaged power switch circuit 30 are mechanically connected to each other through the holder 35.

Figure 5:
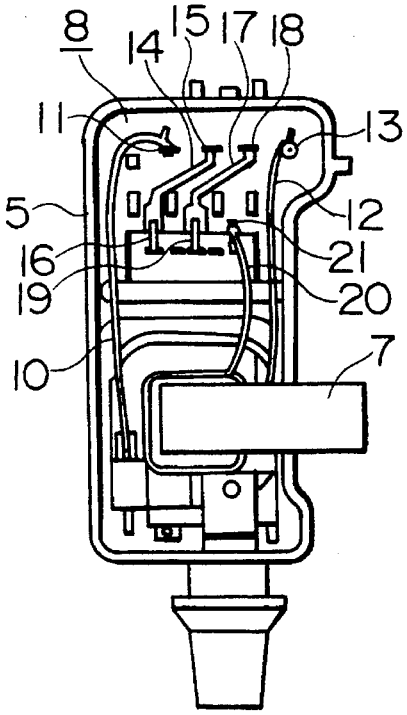
FIG. 5 PRIOR ART
FIG. 5 is a front view of a known ignition coil unit before it is filled by a filler resin.
Figure 6:
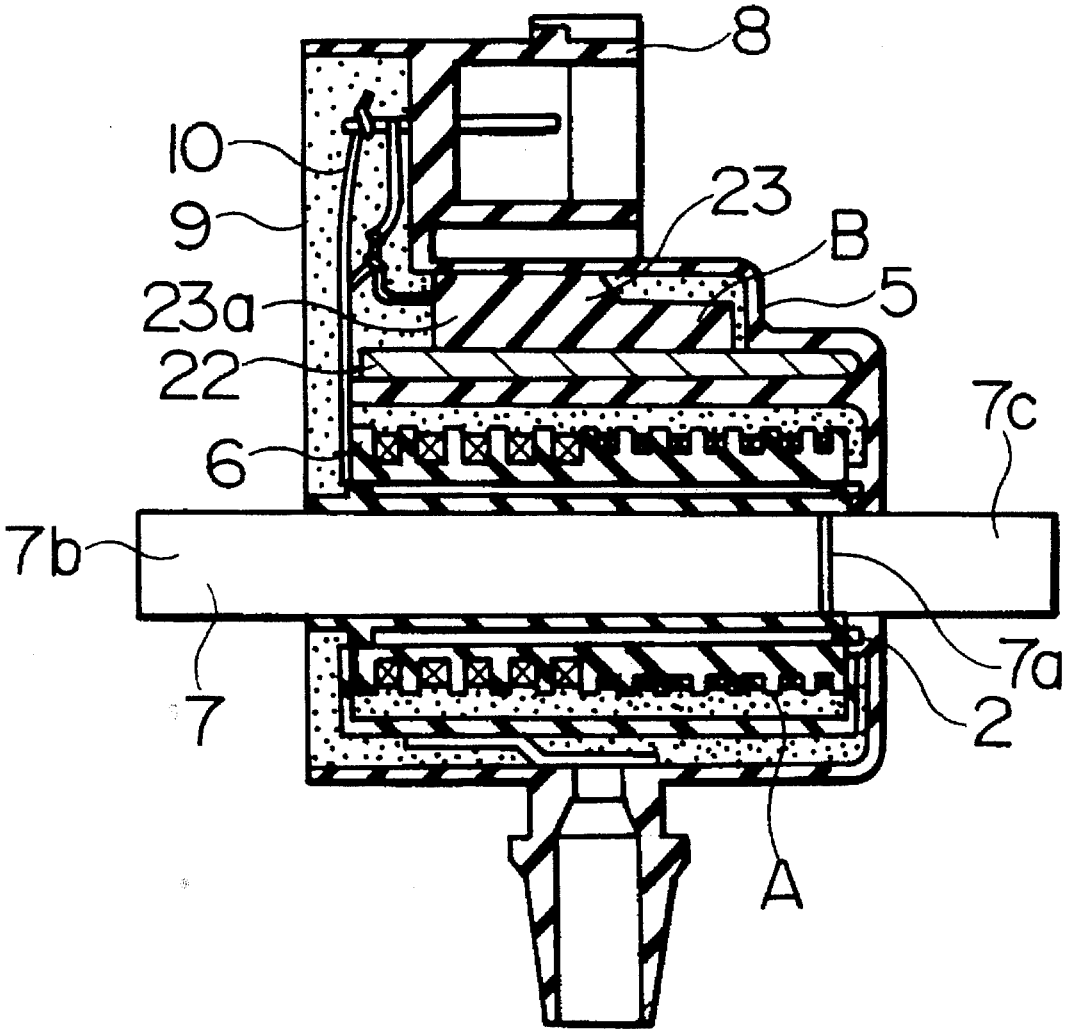
FIG. 6 PRIOR ART
FIG. 6 is a sectional view of a known ignition coil unit illustrated in FIG. 5.

In the manufacture of the ignition coil unit of the present invention as described above, firstly, the packaged power switch circuit 30 and the ignition coil A are mechanically connected to each other by means of the recessed coupler 46 of the holder 35 and the projection 47 of the ignition coil A. Next, the terminals 31, 32, 33 of the packaged power switch circuit 30, the primary and secondary windings 2, 6 of the ignition coil A, the connector terminals 40, 41, 42, 43, 44 and the secondary terminal 45 are electrically connected to each other to assemble the united coil assembly 55 as illustrated in FIG. 3. The united coil assembly 55 is placed and suitably supported within a mold die (not shown) so that an electrically insulating resin 50 is transfer-molded around the coil assembly 55. The transfer-molded resin 50 is formed into a configuration corresponding to the casing 5 of the unit illustrated in FIGS. 5 and 6 and comprises a main body portion accommodating the ignition coil A and the power switch circuit 30, a connector portion defining the connector 8 for external connection, and a tower portion defining the secondary terminal 45 as illustrated in FIG. 3.

According to the ignition coil unit of the present invention as described above, since the packaged power switch circuit is electrically connected to the ignition coil A through the terminals and mechanically assembled into the united coil assembly 55 before they are molded within the molded resin 50, all electrical connections between them can be very easily carried out. Hence, the electrical connection processes between them becomes easy and the connecting portions can be correctly and tightly connected. Therefore the ignition coil unit of the present invention can be easily assembled and reliable. Further, the manufacture processes are improved to be efficient.

What is claimed is:

1. An ignition coil unit for an internal combustion engine, comprising:

a coil assembly having an ignition coil, a power switch circuit having a plurality of electric and electronic components therein for interrupting an electric current flowing through said ignition coil, and a terminal conductor for electrically connecting said coil assembly to an external circuit; and an electrically insulating transfer-molded resin disposed around said coil assembly, said resin establishing a single outer casing for supporting and hermetically sealing therein said coil assembly.

2. An ignition coil unit as claimed in claim 1, wherein said ignition coil, said power switch circuit and said terminal conductor are mechanically connected into said coil assembly.

3. An ignition coil unit as claimed in claim 1, wherein said coil assembly further comprises a connector having a plurality of connector terminals electrically connected to said power switch circuit and said ignition coil.

4. An ignition coil unit as claimed in claim 1, wherein said power switch circuit comprises a mold resin package for hermetically sealing therein said electric and electronic components thereof.

5. An ignition coil unit as claimed in claim 1, wherein said power switch circuit further comprises a holder mounting said power switch circuit for mechanically connecting the power switch circuit to said ignition coil by fastening means provided therebetween.

6. An ignition coil unit as claimed in claim 5, wherein said fastening means comprises;

inserting means provided to said ignition coil;

receiving means provided to said holder for receiving said inserting means;

said inserting means and said receiving means fitted into each other.

7. A method for manufacturing an ignition coil unit, comprising the steps of:

preparing an ignition coil and a power switch circuit having a plurality of electric and electronic components therein for interrupting an electric current flowing through said ignition coil;

electrically connecting said power switch circuit and said ignition coil into a coil assembly; and transfer-molding an electrically insulating resin around said coil assembly to provide a single outer casing for hermetically sealing and supporting therein said coil assembly.

8. A method as claimed in claim 7, further comprising the step of mechanically connecting said ignition coil and said power switch circuit together.

9. A method for manufacturing an ignition coil unit as claimed in claim 7, wherein said power switch circuit is electrically connected to said ignition coil through a connector having a plurality of connector terminals.

10. A method for manufacturing an ignition coil unit as claimed in claim 7, wherein said power switch circuit is mechanically connected to said ignition coil through a holder mounting said power switch circuit by means of fastening means provided to said holder and said ignition coil.

* * * * *